United States Patent [19]

Schäfer et al.

[11] 4,028,869

[45] June 14, 1977

[54] SPINNING MACHINE WITH AUTOMATIC SERVICE CARRIAGE

[75] Inventors: Augustin Schäfer; Klaus Mogg, both of Ebersbach, Germany

[73] Assignee: Zinser Textilmaschinen GmbH, Ebersbach, Germany

[22] Filed: Nov. 24, 1975

[21] Appl. No.: 634,336

[30] Foreign Application Priority Data

Nov. 23, 1974 Germany ..... 2455495

[52] U.S. Cl. ..... 57/34 R; 57/81

[51] Int. Cl.[2] ..... D01H 13/16; D01H 13/14; D01H 15/00

[58] Field of Search ..... 57/1, 34 R, 52–54, 57/56, 78, 81; 242/37 R, 43 R, 35.5 R

[56] References Cited

UNITED STATES PATENTS

| | | | |
|---|---|---|---|
| 3,112,601 | 12/1963 | McCullough | 57/56 X |
| 3,216,668 | 4/1965 | Robertshaw | 57/56 X |
| 3,360,914 | 1/1968 | Black et al. | 57/1 R X |
| 3,432,877 | 3/1969 | Black et al. | 57/56 X |
| 3,523,414 | 8/1970 | Black et al. | 57/56 |
| 3,595,004 | 7/1971 | Saunders | 57/81 |
| 3,651,628 | 3/1972 | Harmon et al. | 57/53 X |
| 3,680,298 | 8/1972 | Saunders | 57/81 X |
| 3,724,192 | 4/1973 | Cardoz | 57/34 R |
| 3,844,101 | 10/1974 | Schwartz | 57/81 |
| 3,908,347 | 9/1975 | Vignon | 57/34 R |
| 3,950,925 | 4/1976 | Igel | 57/34 R |

*Primary Examiner*—Donald Watkins
*Attorney, Agent, or Firm*—Edwin E. Greigg

[57] ABSTRACT

A spinning machine with a plurality of spinning locations or stations is equipped with automatic or semi-automatic spool-changing mechanisms. The machine also has a servicing device, designed for travel along the machine and for repairing thread breakages at some particular spinning location. The presence of this servicing device or carriage at a spinning location would interfere with the operation of the spool-changing mechanism. A controller delivers signals to an appropriate receiver in the servicing device and causes it to depart to a neutral zone at the end of the machine.

6 Claims, 4 Drawing Figures

SPINNING MACHINE WITH AUTOMATIC SERVICE CARRIAGE

BACKGROUND OF THE INVENTION

This invention relates to spinning machines, for example, ring spinning machines, including a plurality of spinning locations serviced by automatically traveling servicing carriages. Such servicing carriages may travel along the various spinning locations and include sensor mechanisms for the detection of broken threads and possibly an accommodation for a human operator. Whenever the thread sensor detects a malfunction or a missing thread at a particular spinning location, the service carriage stops and thus affords the human operator the possibility to repair the thread breakage. In some other cases, the service mechanism is entirely automatic and the carriage travels along the spinning locations and automatically repairs broken threads. Traveling cleaners which travel along the spinning machine and which blow dust and other deposits from the machinery could also be regarded as servicing mechanisms.

Under certain operational conditions of the spinning machine, the presence of the servicing mechanisms within the region of the spinning locations is a hindrance. For example, whenever full cops are removed and emptybobbins are replaced, the presence of servicing mechanisms or carriages is an impediment. This is particularly true when the exchange of bobbins takes place by automatic bobbin change devices located at each and every spinning location and simultaneously for all the spinning locations on one side of the machine. Such an automatic exchange of bobbins can only take place after any servicing mechanism or carriage which may have been present in this region has departed. Thus, after the cops of a particular machine have been filled up and could, in principle, be exchanged for empty bobbins, the production process may be delayed by the presence of any servicing mechanism still in the range of the spinning locations.

OBJECT AND SUMMARY OF THE INVENTION

It is a principal object of the invention to provide a spinning machine and a servicing mechanism which includes means for timely departure from the region of the spinning machine so that the immediate exchange of filled-up cops is not delayed by its presence. This object is achieved by providing a controller within the spinning machines capable of delivering control signals to a receiver located in the servicing mechanism. As a consequence of received signals, the servicing mechanism departs from the region of the spinning locations prior to the completion of the wind-up process on the bobbins. In certain circumstances, the servicing mechanism interrupts its work. It is yet another object of the invention to provide the servicing mechanism or carriage with a selectable rapid movement for the accelerated departure from the region of the spinning locations.

Yet another object of the invention is to provide wireless means for the transmission of control signals from the spinning location to the servicing mechanism. In another embodiment, the control signals pass to the service mechanism by conduction.

The invention will be better understood and further objects and advantages thereof will become more apparent from the ensuing detailed specification of an exemplary embodiment taken in conjunction with the drawing.

DESCRIPTION OF THE PREFERRED EMBODIMENT

Figure 1:
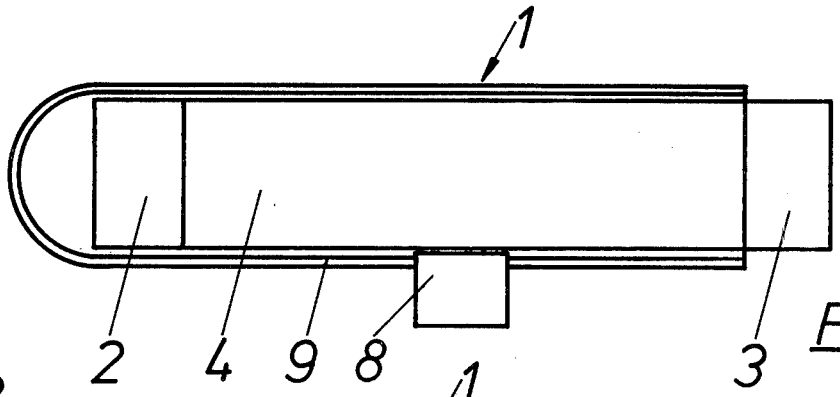
FIG. 1 is a block diagram of a spinning machine including a movable service mechanism in a first operational condition.

Turning now to FIG. 1, there is shown a spinning machine 1 of known construction and, for this reason, not shown or described in great detail. The spinning machine has a front frame 2 and rear frame 3 between which is located the actual machine frame 4 both of whose long sides are equipped in known manner with a series of spinning locations and associated spindles (neither shown). These spinning locations and spindles are serviced by a servicing device 8 moving on a rail 9 which extends along both lines of spindles and also extends around the front frame 2. The servicing device can thus travel back and forth from a position near the rear frame 3 along one row of spindles around the front frame 2 and along the other row of spindles, and during its travel may stop to repair broken threads. It is to be understood that the rail 9 may be continued entirely around the machine or merely around the rear frame 3.

Figure 2:
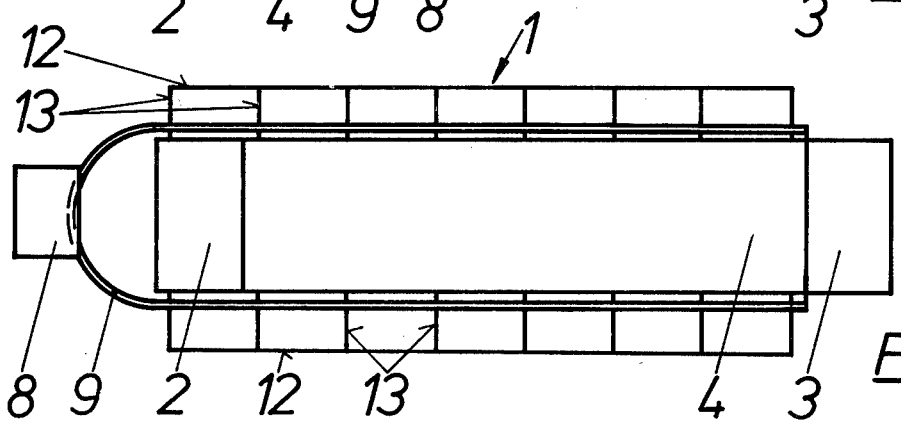
FIG. 2 is a block diagram of the spinning machine similar to that shown in FIG. 1 in a second operational condition.

The spinning machine further includes an automatic mechanism for the removal of wound-up cops and the replacement with empty bobbins. Machinery of this type is known and is thus not further described or shown. This machinery consists substantially of a gripper rail 12 shown in FIG. 2, extending along each of the rows of spindles, which supports gripping and holding members for transporting the full cop and the empty bobbins. A plurality of supports 13 is capable of displacing the gripper rail in the transverse direction.

Figure 3:
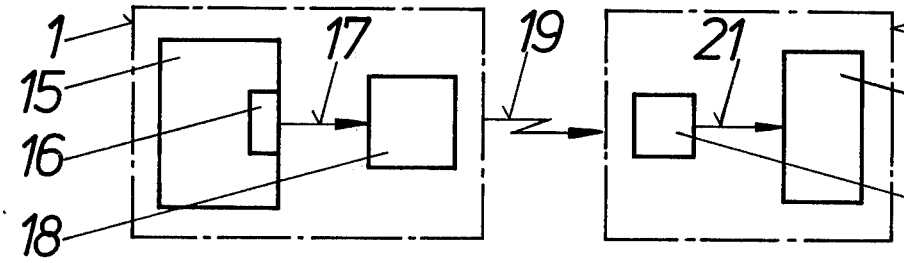
FIG. 3 is a block diagram illustrating the principle of wireless transmission of control signals from the spinning machine to the servicing mechanism.

During normal spinning, i.e., in the operational state shown in FIG. 1, the gripper rails are retracted to the interior of the machine and are thus not visible. Accordingly, these gripper rails do not interfere with the motion of the servicing mechanism 8 during its travel around the machine. In the second operational state of the spinning machine, shown in FIG. 2, i.e., during the removal of full cops and the attachment of empty bobbins, the gripper rails 12 are extended outwardly. This outward motion is possible, however, only if the service mechanism 8 is not located in the region to be occupied by the gripper rails 12, i.e., only if it is removed to the vicinity of the front frame 2. Accordingly, the spool change required when the bobbins have been wound up completely can take place only after the servicing device 8 has departed from the region of the spindles. As is illustrated in FIG. 3, this state is achieved as rapidly as possible by providing a control mechanism 15 within the spinning machine 1. Among other duties, this control mechanism 15 triggers the stoppage of the shipping machine when the bobbins are filled up. The control mechanism 15 also includes a signal generator 16 which delivers a first control signal 17 at an appropriately chosen time to a transmitter 18. In a manner to be described later, the transmitter 18 delivers a signal 19 which travels to and is received by a receiver 20 located in the servicing device 8 and, as a consequence, the servo-mechanism 22 effects the departure of the service carriage 8 from the region of the spindles. It can suitably be provided that the servicing device stops its own operations and departs the region of the spindles in an accelerated fashion.

Figure 4:
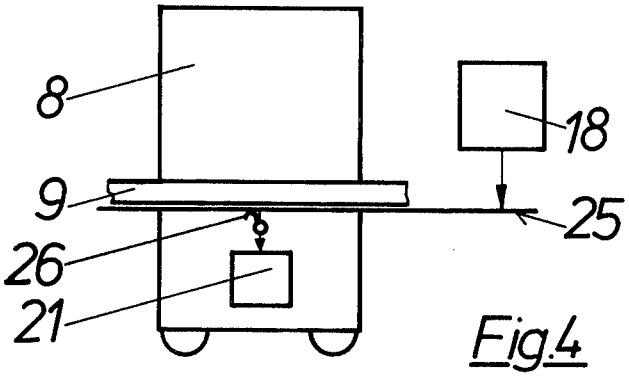
FIG. 4 is an illustration of another form of transmission of control signals to the servicing mechanism.

Advantageously, the time at which the signal generator 16 delivers its control signal 17 is so far ahead of the time of initiation of the spool change that the service carriage 8 can reach its rest position without impeding the spool change mechanism if it is located at the farthest possible point, i.e., in the vicinity of the rear frame 3. The transmission of the signal 19 from the transmitter 18 to the receiver 20 may occur in wireless fashion, for example via electromagnetic waves, i.e., radio waves, or by visible or invisible light, by means of magnetic fields, or by acoustic waves (especially ultra sound) or the like. Devices of this type, by means of which processes are controlled from a distance, are known from the field of model airplanes, from garage door openers, etc., and thus need not be described further here. However, an electric contact rail 25 may be provided as shown in FIG. 4, preferably in association with the rail 9, which is contacted by a sliding contact 26 affixed to the service mechanism 8. In this manner, the signals 19, which could be an electrical voltage of differing amplitude and/or frequency would be transmitted from the transmitter 18 of the spinning machine 1 to the receiver 20 in the servicing device 8.

In many cases, however, it is more advantageous to transmit the signals 19 via the normal power connection of the servicing device 8. In this case, the power connection may be a single or multiple rail, embodied, for example, as shown in FIG. 4 and designated "25" and the signals themselves may be a voltage of different amplitude and/or frequency superimposed on the power supplied to the servicing device 8.

It is clear that other predetermined operational sequences than those described above could be triggered by the receiver 20 after receipt of a datum 21. Furthermore, other and different operational sequences in the service mechanism could be initiated and terminated by differentiating the signals according to polarity, frequency, pulse sequence, etc.,

What is claimed is:

1. In a spinning machine which includes a plurality of spinning locations and including at least one servicing device capable of movement along said spinning locations, the improvement comprising:

control means for sending control signals from said spinning machine to said servicing device for effecting the movement of the servicing device including optionally servicing said locations during the movement; whereby the operation of said servicing device is dependent on operational states of said spinning machine.

2. An improved spinning machine as defined in claim 1, wherein said control means include signal generating means for sending signals for causing the departure of said servicing device from the vicinity of said spinning locations whereby the servicing device moves without further servicing the spinning locations to a rest location where it remains stationary.

3. A spinning machine as defined in claim 2, the improvement further comprising motor means located in said servicing device, for providing motion at a speed greater than a normal speed and wherein said control means are capable of sending signals which activate said motor means to provide said greater speed for departing from the vicinity of said spinning locations.

4. A spinning machine as defined in claim 1, wherein said control means includes signal generating means for sending said signals in timed manner relative to operational events in said spinning machine.

5. A spinning machine as defined in claim 1, the improvement further comprising:

a contact rail, affixed to said spinning machine and substantially extending along said spinning locations and a sliding electrical contact, attached to said servicing device to provide sliding electrical contact with said contact rail; whereby signals from said control means are transmitted to said servicing device through said sliding contact.

6. A spinning machine as defined in claim 1, wherein said control means includes means for generating signals with electrical potentials whose magnitudes are variable with time in a predetermined manner.

* * * * *